United States Patent [19]

Brennan

[11] 3,943,860

[45] Mar. 16, 1976

[54] PALLET SKID DEVICE

[76] Inventor: Francis P. Brennan, 1057 Rolling Drive, Lisle, Ill. 60532

[22] Filed: June 1, 1971

[21] Appl. No.: 148,636

[52] U.S. Cl. ..... 108/55; 108/51

[51] Int. Cl.[2] ..... B65D 19/41; B65D 19/00

[58] Field of Search ..... 108/51–58; 206/65 B; 217/43 A; 214/10.5

[56] References Cited

UNITED STATES PATENTS

| | | | |
|---|---|---|---|
| 1,359,138 | 11/1920 | Wine | 108/58 |
| 1,797,874 | 3/1931 | Millray | 108/51 |
| 1,944,845 | 1/1934 | Rickwood | 108/55 |
| 2,099,051 | 11/1937 | Clark et al. | 108/51 |
| 2,218,022 | 10/1940 | Donnell et al. | 108/51 |
| 2,563,800 | 8/1951 | Bitney | 108/55 X |
| 2,626,456 | 1/1953 | Harrison | 108/55 X |
| 2,716,532 | 8/1955 | Wysong, Jr. et al. | 108/55 X |
| 2,828,931 | 4/1958 | Harvey | 108/54 H X |
| 2,942,827 | 6/1960 | Edson | 108/54 |
| 3,101,063 | 8/1963 | Wharton | 108/55 |
| 3,168,879 | 2/1965 | Clark, Jr. | 108/55 |
| 3,172,374 | 3/1965 | Allen | 108/51 |
| 3,405,666 | 10/1968 | Miller | 108/58 |
| 3,430,586 | 3/1969 | Oswald | 108/55 |
| 3,581,907 | 6/1971 | Schmidt | 108/52 |
| 3,641,948 | 2/1972 | Brown | 108/51 |

FOREIGN PATENTS OR APPLICATIONS

| | | | |
|---|---|---|---|
| 82,225 | 10/1956 | Denmark | 108/51 |

*Primary Examiner*—Paul R. Gilliam
*Assistant Examiner*—G. O. Finch
*Attorney, Agent, or Firm*—Hill, Gross, Simpson, Van Santen, Steadman, Chiara & Simpson

[57] ABSTRACT

An expendable pallet skid device formed from a metal strip having vertical legs extending from opposite ends of the strip and slotted to enable straps to secure two or more pallet skids to the bottom of a container or other articles, such as stacks of corrugated sheets, boxes, laminar metal sheets, plywood, or other items, to enable the load to be lifted and transported by the forks of a fork lift or pallet truck.

4 Claims, 14 Drawing Figures

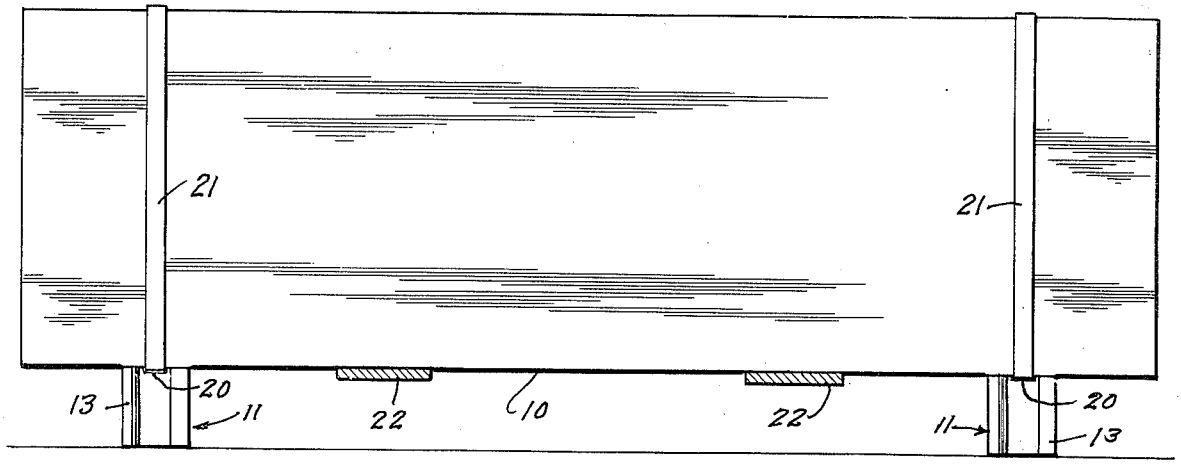
Fig.1
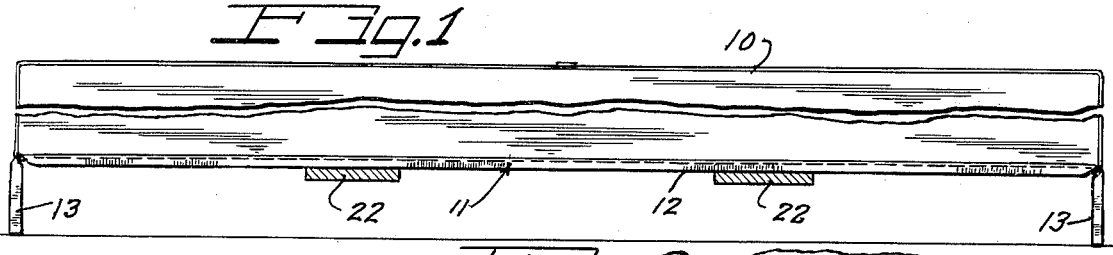
Fig.2
Fig.6
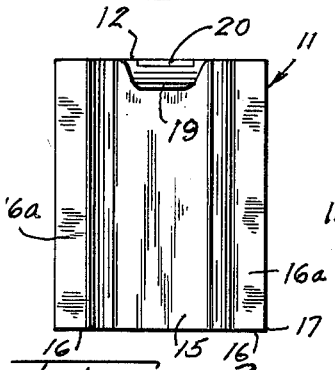
Fig.3
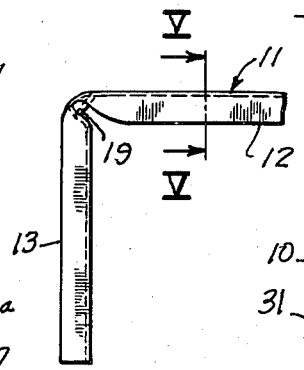
Fig.4
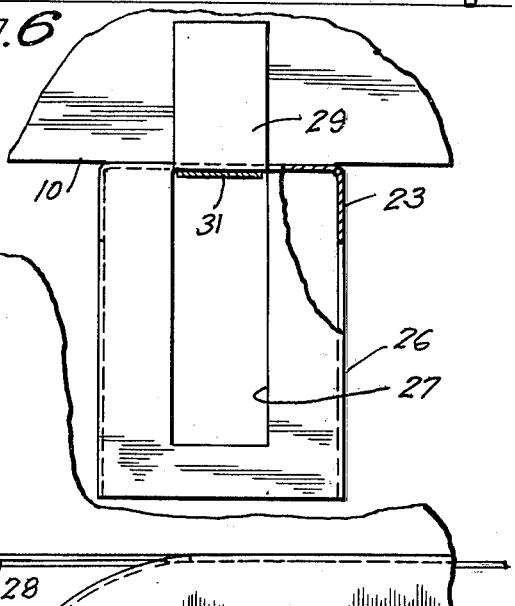
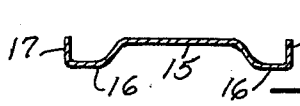
Fig.5
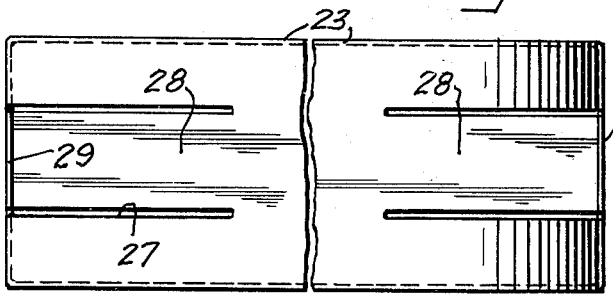
Fig.9
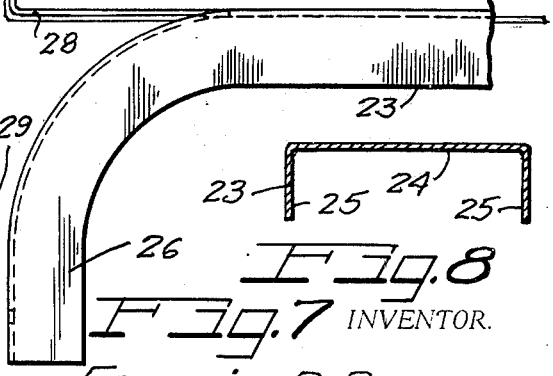
Fig.7
Fig.8
INVENTOR.
Francis P. Brennan
BY Hill, Sherman, Meroni, Gross + Simpson ATTORNEYS INVENTOR.
Francis P. Brennan BY Hill, Sherman, Meroni, Gross & Simpson ATTORNEYS

PALLET SKID DEVICE

THE FIELD OF THE INVENTION

This invention relates generally to pallet devices for utilization in connection with material to be handled by lift trucks.

THE PRIOR ART

Most pallet devices have heretofore been made from wooden runners supporting a platform and extending for the length of the platform. Pallet devices have also been attained by attaching wooden runners to the bottom of a container or load, which extend for the length of a container or load so the forks of a fork lift truck can only be inserted between the pallet skid devices. The articles to be transported must thus be physically loaded on the platform or where the wooden runners are attached to a load, the forks of a fork lift truck can extend under the load from only two directions, and the mounting of the skids to the bottom of the load materially increases the weight of the container or load and the resultant shipping cost of the container or load.

SUMMARY OF THE INVENTION

According to the present invention, an inexpensive light-weight pallet device is provided in the form of independent skids having vertically extended legs at opposite ends and designed to be strapped conveniently to a container, a stack of corrugated boards or boxes, laminar metal sheets, plywood or other items, to support the container or other items above the ground, to be lifted by the forks of a fork lift truck extending either between the pallet skid devices or between the legs thereof, or at any angle with respect to the legs.

Each pallet skid device is formed from a metal strip having vertical legs formed from opposite ends of the strip, enabling the body of the strip to be strapped or otherwise detachably secured to the bottom of a load to be lifted by the forks of a fork lift truck, since in many cases the load to be shipped may be used to form a pallet. The runners are, therefore, all that is required since the load itself may form the pallet, thereby eliminating the necessity of an additional platform to support the load.

The present invention, therefore, provides an inexpensive pallet skid device in which skids having opposite vertical legs are so constructed and arranged as to be strapped to the bottom of a load so the fork of a fork lift truck may be inserted along the bottom of the load from any selected side and angle.

The invention also converts the bottom of the container or bottom articles of a stack of articles to a pallet by the use of a plurality of simplified skids formed from a strip of metal, to have opposite legs and a body connecting the legs together, to be detachably attached to the bottom of a container or other articles to be transported. The invention also provides a series of pairs of connected detachable legs for supporting a load to be lifted by the forks of a fork lift truck either from the ends, sides or from any angle relative to the container or other articles.

Other advantages, features and objects of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE DRAWINGS

FIG. 1 is a view in side elevation of a container having two pallet skid devices constructed in accordance with the principles of the present invention strapped to the bottom of the container, to support the container above the ground.

FIG. 2 is a view in side elevation of the pallet skid device illustrated in FIG. 1, showing the pallet skid device strapped to a container.

FIG. 3 is an end view of the pallet skid device shown in FIGS. 1 and 2.

FIG. 4 is a fragmentary side elevational view of the pallet skid device, showing the body of the pallet skid device broken away.

FIG. 5 is a transverse sectional view taken substantially along line V—V of FIG. 4, illustrating the beaded construction along the edges of the body of the pallet skid device.

FIG. 6 is an end view of a modified form of pallet skid device constructed in accordance with the principles of the present invention.

FIG. 7 is a partial fragmentary side elevational view of one end portion of the pallet skid device shown in FIG. 6.

FIG. 8 is a transverse sectional view taken through the body of the pallet skid device.

FIG. 9 is a fragmentary plan view of the pallet skid device shown in FIGS. 6 through 8, with the body of the pallet skid device broken away.

DESCRIPTION OF THE PREFERRED EMBODIMENTS

Figure 10:
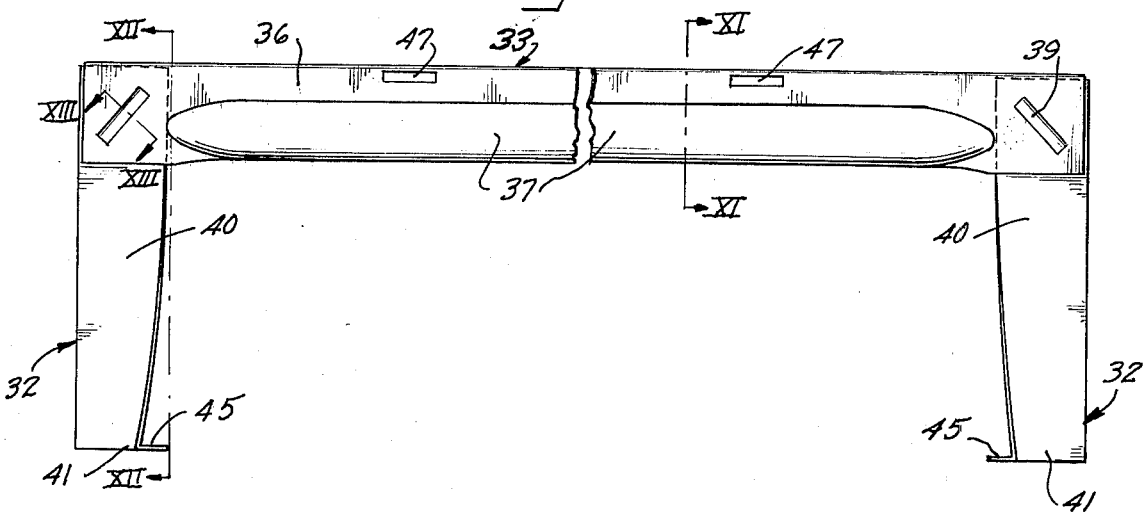
FIG. 10 is a view in side elevation of still another form in which the invention may be embodied.

In FIGS. 1 and 2 of the drawings, I have shown a typical container 10 in the form of a box or carton supported on two spaced pallet skid devices 11, elevating the bottom of the container above the ground, to accommodate the forks of a fork lift truck to come into engagement with the bottom of the container from either the ends or the sides thereof or from any angle relative to the ends or sides of the container. The container 10 may be a corrugated container, but may also be a fiber board container or a wooden box, or may be a corrugated, fiber, wooden board or metal sheet adapted to support a stack of flat boards or other flat articles thereon.

Each pallet skid device 11 may be stamped or otherwise formed from an elongated strip of sheet metal, forming the strip into a horizontally extending body 12 having vertical legs 13 bent downwardly from opposite ends thereof. The body 12 of the strip is shown in FIG. 5 as being in the general form of an inverted channel having a central web 15, beads 16, 16 integrally formed by a pressing or stamping operation to depend from opposite ends of the web and terminating into upright flange portions 17, 17 extending along opposite sides thereof and upwardly of the bottoms of the beads along the body portion 12 of the pallet skid device. The leg portions of the pallet skid are of a similar form except beads 16a in alignment with the beads 16 face outwardly and the flanges face inwardly. This adds to the strength of the skid at the joint between the legs and body. The beads 16 extending along opposite sides of the web 15 provide an integral reinforcement for the pallet skid structure, resisting bending or buckling of the body and reinforcing the legs to support relatively great compressive loads.

The legs 13, 13 are further reinforced against bending relative to the body of the pallet skid device by pressing inwardly at the corners between the body and legs with a die or other device, to provide a flattened portion of the webs of the legs and body, extending at an angle with respect to the legs and body and forming an integral inwardly pressed gusset 19. A slot 20 extends through the gusset 19 and accommodates a strap 21 to pass therethrough and strap the pallet skid device to the bottom of a container, board, plate, sheet or other article, to be held in spaced relation with respect to the ground, to be lifted by the forks of a fork lift truck and the like.

As, for example, in FIG. 1, I have shown forks 22 of a fork lift truck extending inwardly from the side of the container between the pallet skid devices, to lift the container and pallet skid devices vertically. In FIG. 2 I have shown similar forks 22 of a fork lift truck extending under the container and pallet skid devices from an end of the container to effect lifting of the container and pallet skid devices. The forks, however, may come under the container from any desired angle relative to the ends and sides of the container. It should also be understood that while I have only shown two pallet skid devices 11 in supporting engagement with the bottom of the container 10, that more than two pallet skid devices may be used if desired.

It should also be noted that in FIG. 2 the body 12 is of sufficient length to space the outer sides of the legs 13 slightly outwardly of the sides of the container as a protection against crushing loads.

In the form of the invention illustrated in FIGS. 6 through 9, each pallet skid device is formed from an inverted channel 23 having a web 24 and parallel flanges 25 extending downwardly from opposite sides thereof and for the length of the channel. Opposite legs 26 of the pallet skid device are formed by bending the opposite ends of the channel downwardly along a uniform arc to provide the reinforcement of an arch. The legs 26 are cut away to form slots 27 extending downwardly therealong. The material in the legs is then bent to extend horizontally from the body of the pallet skid device to positions approximating the ends of the legs as indicated by reference numeral 28 and is then bent upwardly to form an upwardly extending retainer flange 29, engageable with a side of a container 10, to retain the container from movement along the body. A strap 31 is shown as extending along the bottom of the web 24 and through the slots 27 and upwardly along the outsides of the retainer flanges 29, to strap the container to the respective pallet skid device, as in the form of the invention illustrated in FIGS. 1 through 5.

The pallet skid device of FIGS. 10 to 14 is made from a single channel-like member having legs 32 bent downwardly from opposite ends of a channel-like body member 33. The body member 33 of the pallet skid device is shown in section in FIG. 11 and is in the form of a downwardly opening channel having a base 35 and depending flanges 36 with ribs or beads 37 embossed in said flanges from the insides thereof, to extend outwardly of said flanges. The ribs 37 extend along the flanges 36 of the channel in the space between the legs 32 of the pallet skid device, and stop short of said legs.

The pallet skid device may be formed from a unitary channel-like blank having the ribs 37 pressed outwardly of the flanges 36 along the body portion of the blank. The flanges 36 of the blank may be slit to accommodate the ends thereof to be bent at right angles with respect to the body thereof, to form support legs 32. As the flanges 36 are slit and bent about opposite ends of the body member 33 they are pressed inwardly to come along the insides of the legs 36 of the body member into close contact therewith. The apparatus for slitting, bending and pressing the flanged portions of the legs 32 inwardly to cause the flanged side portions of the legs to move under the flanges 36 of the body in close contact therewith may perform these operations by the proper design and use of a progressive die in one continuous series of operations. The apparatus and die may be of a form well known to those skilled in the art, and is no part of the present invention, so need not herein be shown or described further.

As the legs 32 are bent in position at right angles with respect to the body 33 of the blank, rib shaped shear forms are pressed inwardly of the flanges 36 and flanged portions 40 of the legs 32 and extend diagonally of the flanges 36 adjacent opposite ends thereof and into and along the upper portions of the flanged portions of the legs 32. The shear forms 39 at opposite ends of the flanges 36 face in opposite directions and are pressed inwardly from opposite flanges 36 of the body 33 into the flanged portions 40 of the legs 32. Said rib shaped shear forms form an interlocking shear connection between said flanges and flanged portions of said legs and in effect form a shear form weld between the legs 32 and body 33, and gusset the legs to the body 33 and positively hold the legs 32 at right angles with respect to the body 33, with the ends of the flanged portions of said legs 40 engaging beneath the base 35 of the body 33. This provides a strong load supporting pallet skid device of a simple and improved construction without the necessity of spot welding or any further fabrication.

The flanged portions 40 of the legs 32 are flared outwardly at the base of said legs, as indicated by reference numeral 41 to provide a widened base for the pallet skid device.

Figure 14:
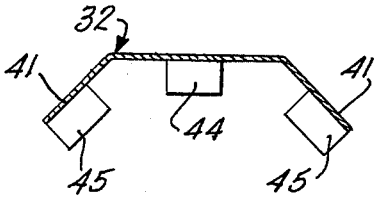
FIG. 14 is a sectional view taken substantially along line XIV—XIV of FIG. 10.

Flanges 44 extend inwardly from the bottom portions of the webs of the legs 32. Other flanges 45 extend inwardly from the bottom portions of the bottom flared portions 41 of the flanges 40 of the legs 32, as shown in FIG. 14. These flanges together with the widened base for the legs 32 formed by the pallet skid device, formed by flaring the legs outwardly as they approach the ground, enlarge the bearing area of the legs on the floor and, besides forming a stable base for the pallet skid device form a protection for softer surfaces on which a load may be sitting.

Figure 12:
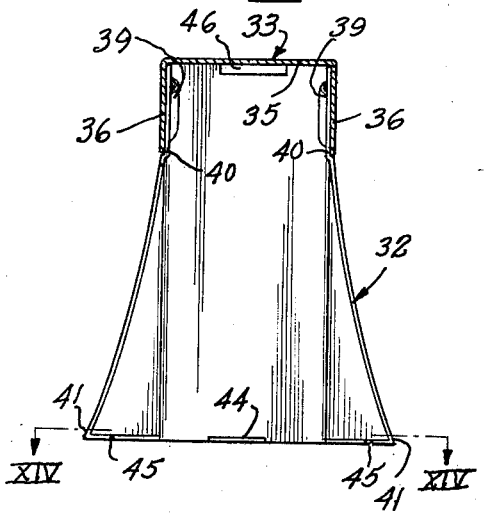
FIG. 12 is a transverse sectional detail view taken substantially along line XII—XII of FIG. 10.
Figure 11:
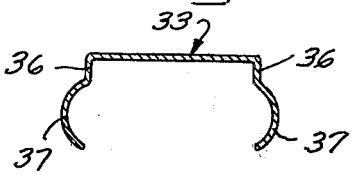
FIG. 11 is a sectional view taken substantially along line XI—XI of FIG. 10.
Figure 13:
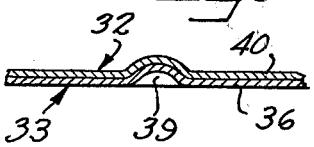
FIG. 13 is a partial fragmentary sectional view taken substantially along line XIII—XIII of FIG. 10.

In FIG. 12, I have shown a transverse slot 46 extending through a leg 32 adjacent to the top thereof, and substantially in alignment with the bottom of the web 35 of the body 33. Each leg 32 has a similar slot 46 which accommodates a strap or like connector to extend through said legs in engagement with the underside of the web of the body 33 and upwardly from said legs along opposite sides of a load, such as a container or other article to be supported on a pair of parallel spaced pallet skid devices, as in the forms of the invention illustrated in FIGS. 1 to 9. I have also shown horizontal slots 47 spaced along the flanges 36, to receive straps or the like, extending at right angles to the straps extending through the slots 46 extending through the legs 32.

The form of pallet skid device just described provides a low cost rugged structure particularly adapted for heavy loads, which may be strapped to stay with the load until delivery and then thrown away, or which may be removed and reused as the load is placed on a truck, railway car or other vehicle. This device can be provided in almost any suitable length practical for common use, as for example, from 1 foot to 10 feet and over.

It may be seen from the foregoing that several simple, rugged and inexpensive forms of pallet skid devices have been provided, which may be formed from a section of beaded or channelled sheet metal to provide a body and vertical legs extending perpendicularly of the body, for supporting the body and container or articles thereon in vertically spaced relation relative to the ground. It may further be seen that two or more pallet skid devices may be provided to support a container, board, stack of boards or other materials above the ground to be lifted by the forks of a lift truck, and that the forks of the lift truck are not confined to extend inwardly from only two sides to lift the load, as is customary with most present-day pallets, but may be extended under the load from either side or either end of the load or at an angle relative to the load.

I claim as my invention:

1. In a pallet skid device, at least two independent skids, each having an elongated horizontal body portion channel-like in cross section and having legs channel-like in cross section extending downwardly from opposite ends of said body at right angles with respect thereto and formed integrally therewith, the legs having slots extending transversely thereof arranged to accommodate the strapping of an article to be lifted to said body portion by the insertion of strapping means through said slots and about said body portion, to support a load in vertically spaced relation with respect to the ground, and provide a free space between said legs both longitudinally of said skids and transversely thereof and thereby accommodate the forks of a fork lift truck to come into lifting engagement with the bottom of the load from the ends or sides of the load and at angles relative to the ends and sides of the load without interference by said pallet skid device, said body having beads extending along opposite sides thereof and depending therefrom, forming the body into a downwardly opening channel extending for the length thereof, and said legs having beads extending along opposite sides thereof aligned with the beads extending along the body and extending outwardly of said legs and forming said legs into outwardly opening stiffened channels.

2. The pallet skid device of claim 1, wherein the legs are bent at right angles with respect to the body, and wherein integral gussets pressed inwardly of the corners of the junctures of the legs with the body form reinforcing gussets retaining the legs in perpendicular relation relative to the body.

3. In a pallet skid device, at least two skids, each having an elongated horizontal body portion channel-like in cross section having an outer web and flanges depending therefrom and having legs formed integrally therewith and extending downwardly from said body and having an outer web and flanges extending inwardly therefrom and underlapping the flanges of the body, and the upper ends of the flanges of the legs having abutting engagement with the underside of the web of the body to form a gusseting support therefor, integrally formed stiffening means extending along the flanges of the body between the legs of the pallet skid device and oppositely facing shear forms extending diagonally along the flanges of the body and pressed into the flanges of the legs to positively retain said legs to the flanges of the body, said integrally formed stiffening means comprising embossments in the form of rounded beads extending outwardly along the flanges of the body between the legs of the pallet skid device.

4. In a pallet skid device, at least two skids, each having an elongated horizontal body portion channel-like in cross section having an outer web and flanges depending therefrom and having legs formed integrally therewith and extending downwardly from said body and having an outer web and flanges extending inwardly therefrom and underlapping the flanges of the body, and the upper ends of the flanges of the legs having abutting engagement with the underside of the web of the body to form a gusseting support therefor, integrally formed stiffening means extending along the flanges of the body between the legs of the pallet skid device and oppositely facing shear forms extending diagonally along the flanges of the body and pressed into the flanges of the legs to positively retain said legs to the flanges of the body, the lower portions of said legs having integrally formed ground engaging flanges forming a protection for softer surfaces on which a load supported on said pallet skid devices may be sitting, a slot extending through each leg adjacent the base of the body of the channel, and laterally aligned longitudinally spaced horizontal slots extending through the flanges of the body adjacent the tops of said flanges, said slots in said legs and flanges accommodating straps to pass therethrough for strapping a load to the body of the pallet skid device.

* * * * *